US005464116A

United States Patent [19]

Aoki et al.

[11] Patent Number: 5,464,116

[45] Date of Patent: Nov. 7, 1995

[54] INSULATION STRUCTURE FOR LIQUEFIED GAS TANK

[75] Inventors: Eiji Aoki, Yokohama; Koichiro Yamada, Tokyo; Tatsuhiko Yukitomo, Yokohama, all of Japan

[73] Assignee: Ishikawajima-Harima Jukogyo Kabushiki Kaisha, Tokyo, Japan

[21] Appl. No.: 240,624

[22] Filed: May 11, 1994

[30] Foreign Application Priority Data

| | | | |
|---|---|---|---|
| May 20, 1993 | [JP] | Japan | 5-118501 |
| May 27, 1993 | [JP] | Japan | 5-126093 |
| Jun. 3, 1993 | [JP] | Japan | 5-133516 |

[51] Int. Cl.[6] ..... B65D 87/24

[52] U.S. Cl. ..... 220/586; 220/4.13

[58] Field of Search ..... 220/581, 586, 220/4.05, 4.13, 467, 468

[56] References Cited

U.S. PATENT DOCUMENTS

| | | | |
|---|---|---|---|
| 3,411,656 | 11/1968 | Jackson | 220/586 |
| 3,780,900 | 12/1973 | Yamamoto | 220/586 |
| 3,948,198 | 5/1976 | Yamamoto et al. | 220/586 |
| 3,975,879 | 8/1976 | Birch et al. | 220/586 |
| 4,023,726 | 5/1977 | Massac . | |
| 4,050,609 | 9/1977 | Okamoto et al. . | |

FOREIGN PATENT DOCUMENTS

| | | |
|---|---|---|
| 2264712 | 10/1975 | France . |

*Primary Examiner*—Joseph Man-Fu Moy

*Attorney, Agent, or Firm*—Oblon, Spivak, McClelland, Maier & Neustadt

[57] ABSTRACT

Each of insulation panels which form together an insulation layer is fixed on a tank body at one point at the center of the panel. An insulation material having elasticity at low temperature is filled in a joint between the adjacent panels. A heat insulator having elasticity at a given temperature and high heat insulating property is airtightly fitted in the joint. A balance hole for preventing pressure change is provided in the insulation layer.

10 Claims, 7 Drawing Sheets

INSULATION STRUCTURE FOR LIQUEFIED GAS TANK

BACKGROUND OF THE INVENTION

The present invention relates to an insulation structure for a liquefied gas tank.

In general, a liquefied gas ship for transporting liquefied gas such as LNG at low temperature has a structure as shown in FIG. 1 in which a tank body 1 made of aluminum alloy with its outer surface covered with an insulation layer 4 is supported by heat-insulating supports 2 on a bottom of an inner shell 3 of a hull.

The insulation layer 4 comprises a plurality of insulation panels made of for example polyurethane foam. Each of the panels is supported at its four corners by support members such as rods protruded from the outer surface of the tank body 1 and is fixed to the tank body 1 by tightening a fastening member such as nut on a threaded tip end of each support member through a holding member such as washer.

Fixing the panels at their four corners to the tank body 1 will require a great number of support members, holding members and fastening members, which leads to higher cost as well as much labor and time in mounting the panels, and will cause the panels and the support members themselves to have stresses upon shrinkage of the panels. At joints between the panels, under influence of shrinkage of the tank body 1 which is cooled down by the liquefied gas at low temperature, the adjacent panels apply forces to each other and stress is likely to occur.

In order to eliminate the above problems, the present invention has for its object to provide an insulation structure for a liquefied gas tank in which mounting of the insulation panels is facilitated and occurrence of stresses at joints between the panels is prevented.

BRIEF SUMMARY OF THE INVENTION

In an insulation structure for a liquefied gas comprising a plurality of insulation panels to define together an insulation layer covering an outer surface of a tank body, the present invention provides an improvement which comprises a mounting member for each of said panels, said mounting member being fixed to the outer surface of the tank body at a position opposite to a stiffening member attached to an inner surface of the tank body, a support member protruded from said mounting member and passing through a central bore of said panel, said central bore being larger in diameter than the support member, a cylindrical member between said mounting member and the panel for protecting the panel, a pad narrower in width than the panel and longitudinally extending along said stiffening member, said pad being arranged between the outer surface of the tank body and the panel and a fastening member tightened on a tip end of said support member through a holding member, whereby each of the panels is mounted on the outer surface of said tank body with a clearance.

Preferably, each of said support member, holding member and fastening member is made of material having high heat insulating property.

A joint between the adjacent panels may have a low-temperature-side gap and a normal-temperature-side gap wider than the low-temperature-side gap beth defined by the adjacent panels, an insulation material having elasticity at low temperature being filled into the low-temperature-side gap, a partition tape being applied on a boundary between said low- and normal-temperature-side gaps to shield the boundary, a heat insulator having elasticity at a given temperature being airtightly fitted into the normal-temperature-side gap.

At a bottom of the tank body, a joint between the adjacent panels may have a low-temperature-side gap and a normal-temperature-side gap wider than the low-temperature-side gap both defined by the adjacent panels, an insulation material having elasticity at low temperature being filled into the low-temperature-side gap, a partition tape being applied on a boundary between said low- and normal-temperature-side gaps to shield the boundary, an insulation joint member being airtightly fitted into the normal-temperature-side gap adjacent to said partition tape, said joint member being made of the same material as the panels and having an elastically deformable portion at one side thereof, a heat insulator having elasticity at a given temperature being airtightly fitted into the normal-temperature-side gap away from said partition tape.

At a side outer surface of the tank body, a joint between the adjacent panels may have a low-temperature-side gap and a normal-temperature-side gap wider than the low-temperature-side gap both defined by the adjacent panels, an insulation material having elasticity at low temperature being filled into the low-temperature-side gap, a partition tape being applied on a boundary between said low- and normal-temperature-side gaps to shield the boundary, an insulation joint member being fitted into the normal-temperature-side gap adjacent to said partition tape, said joint member being made of the same material as the panels and attached at one side thereof to one of said adjacent panels while the other side of the joint member is spaced apart from the other of said adjacent panels opposing thereto, a heat insulator having elasticity at a given temperature being airtightly fitted into the normal-temperature-side gap away from said partition tape.

At a top outer surface of the tank body, a joint between the adjacent panels may have a low-temperature-side gap and a normal-temperature-side gap wider than the low-temperature-side gap both defined by the adjacent panels, an insulation material having elasticity at low temperature being filled into the low-temperature-side gap, a heat insulator having elasticity at a given temperature being airtightly fitted into the normal-temperature-side gap.

Preferably, the insulation layer constituted by said panels and covering the tank body with the clearance has a balance hole passing therethrough at a substantially highest position on the layer, said balance hole communicating said clearance with outside of the insulation layer.

Therefore, in the structure according to the present invention, because of the cylindrical member between the mounting member and the insulation panel, the insulation material is not in direct contact with the support member and a certain gap or space is maintained between the support member and the central bore of the panel. The panel is reliably fixed at one point at the center thereof to the tank body free from being damaged due to contact with the support member. Compared with the conventional ways of fixing the panel at four corners thereof, the number of support members, fastening members and holding members required is reduced, which contributes to cost reduction and to improvement of efficiency in mounting the panels. No stress occurs in the panel since the panel may freely contract toward the point at the center thereof. Tank-body wall portions with no stiffening member may be deformed into corrugation due to for example the pressure of the liquefied gas inside; however, because the mounting member is fixed to the outer surface of the tank body at a position opposite to the stiffening member on the inner surface of the tank body and a pad narrower in width than the panel and longitudinally extending along the stiffening member is arranged between the outer surface of the tank body and the panel and also because the panel is mounted on the outer surface of the tank body with the given clearance, the panel is not influenced by displacement or corrugation of the tank-body wall portions. Thus, the panels are subject neither to damage nor to excessive force applied to the mounting members. Because of each panel being mounted on the outer surface of the tank body with the clearance, even when the liquefied gas leaks from the tank body by any chance, the liquefied gas quickly moves through said clearance and is collected at a given point on the bottom of the insulation.

When each of the support member, holding member and fastening member is made of material having high heat insulating property, heat outside the tank body is hardly propagated to the tank body, which enhances the insulation property of the tank body.

When the insulation material having elasticity at low temperature is filled into the low-temperature-side gap of the joint between the adjacent panels and the partition tape is applied to the boundary between the low- and normal-temperature-side gaps to shield the boundary and the heat insulator having elastic property at a given temperature and high heat insulating property is airtightly fitted into the normal-temperature-side gap, the partition tape prevents outflow of cold gas such as air or gaseous nitrogen which otherwise tends to escape to outside through the insulation material filled in the low-temperature-side gap due to the influence of gravitational force especially at the bottom of the tank body: and the heat insulator reliably blocks heat transfer to and from outside. Shrinking of the panel and influence of shrinkage of the tank body cooled down by low temperature liquefied gas are absorbed by the insulation material and by the heat insulator and no stress occurs in the panel. The joint itself is not damaged since it is soft.

When, in addition to the insulation material, the partition tape and the heat insulator, the insulation joint member is used which is made of the same material as the panels, has the elastically deformable portion at one side thereof and is airtightly fitted into the normal-temperature-side gap adjacent to the partition tape or between the partition tape and the heat insulator, then heat transfer to and from outside is reliably blocked by the joint member and the heat insulator. Shrinking of the panel and influence of shrinkage of the tank body cooled down by low temperature liquefied gas are absorbed by the insulation material and by the heat insulator as well as by the insulation joint member which may be expanded or shrunk while maintaining the same heat insulating performance as the panels due to its elastically deformable portion formed by the same material as the panels; and no stress occurs in the panels. If low-temperature liquefied gas leaks from the tank body by any chance, the leaked liquid flows into the low-temperature-side gap through the clearance between the tank body and the panel so that the joint member may be cooled down via the partition tape: however, since the same material as the panels is used for the joint member, the joint member is not detached from the panels through hardening and shrinkage thereof due to cooling. Even if the liquid flows out through the partition tape, liquid-tightness is satisfactorily maintained and outflow of the leaked liquid to outside is prevented.

At the side outer surface of the tank body where influence of gravitational force is lower than at the bottom of the tank body with respect to outflow of cold gas, outflow of cold gas to outside is reliably blocked by the partition tape. The joint member is used which is made of the same material as the panels and attached at one side thereof to one of said adjacent panels while the other side of the joint member is spaced apart from the other of said adjacent panels opposing thereto. Heat transfer to and from outside is reliably excluded by the joint member not airtightly fitted in the gap as well as the heat insulator. Shrinking of the panel and influence of shrinkage of the tank body cooled down by low temperature liquefied gas are absorbed by the insulation material, the insulation joint member and the heat insulator. Thus, no stress occurs in the panels.

At the top outer surface of the tank body where gravitational force works against outflow of cold gas to outside, outflow of the cold gas to outside is prevented with no partition tape. Heat transfer to and from outside is reliably prevented by the heat insulator in the normal-temperature-side gap. Shrinking of the panel and influence of shrinkage of the tank body cooled down by low temperature liquefied gas are absorbed by the insulation material and by the heat insulator. No stress occurs in the panels.

When the insulation layer constituted by said panels and covering the tank body with the clearance has the balance hole passing therethrough at a substantially highest position on the layer and said balance hole communicates said clearance with outside of the insulation layer, gas may freely move between the clearance and the outside of the layer through the balance hole upon any pressure change in the clearance due to temperature change or other causes. As a result, the pressure in the clearance of the insulation layer is equalized with the pressure outside the layer, which prevents deformation of the tank body due to pressure increase in the clearance of the layer. Detaching of the insulation layer from the tank body and the resultant decrease in the insulation effect are also prevented. Since the gas moves in and out only upon pressure changes and the balance hole is provided at the substantially highest position on the layer, the cold gas does not flow out of the insulation layer by gravitational force and heat insulating performance is maintained at high level.

The present invention will become more apparent from the following description on a preferred embodiment thereof taken in conjunction with the accompanying drawings.

DETAILED DESCRIPTION OF THE PREFERRED EMBODIMENT

Figure 1:
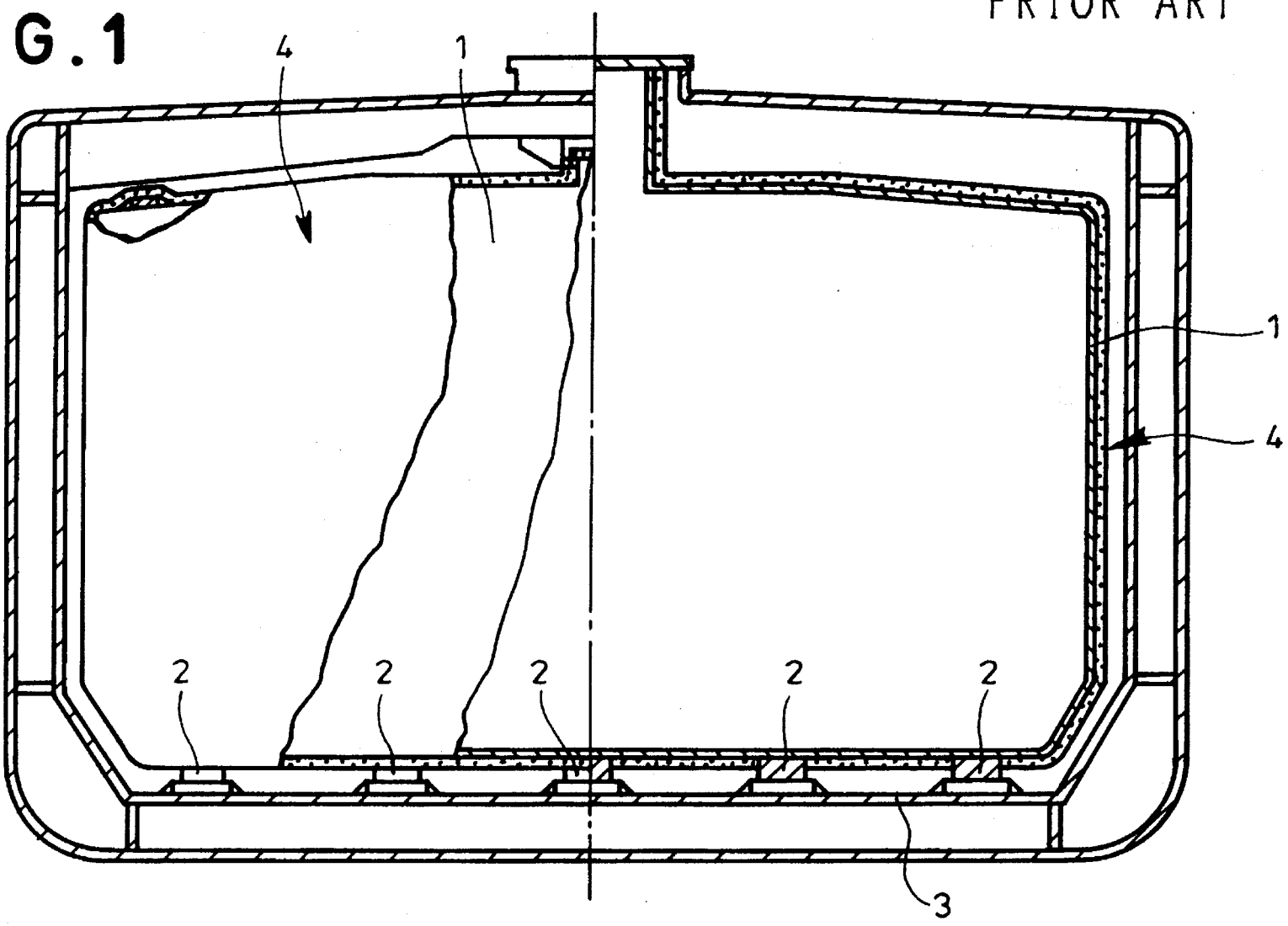
FIG. 1 is a general transverse section of a tank body of a liquefied gas ship.
Figure 2:
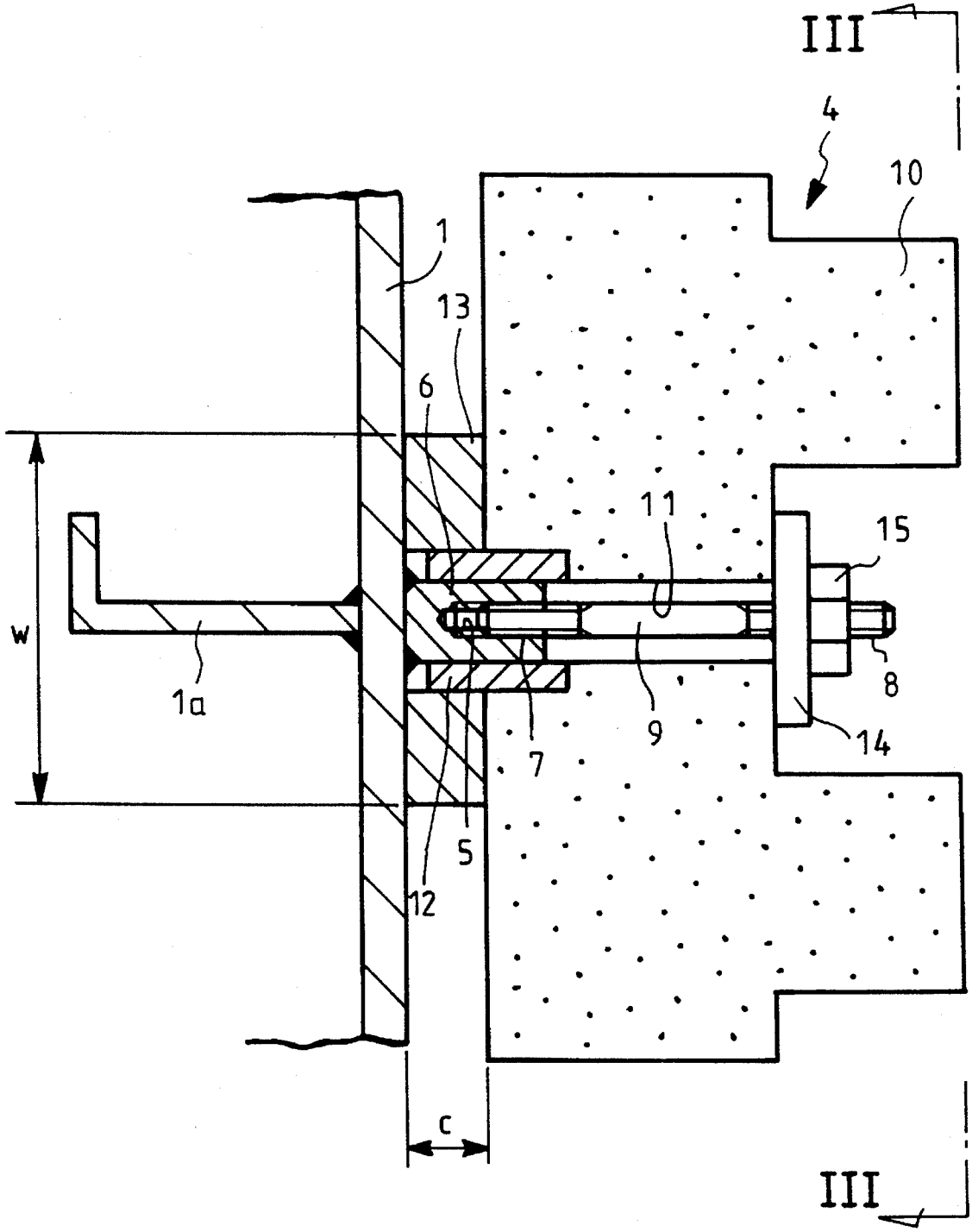
FIG. 2 is an enlarged section of an embodiment of the present invention.
Figure 3:
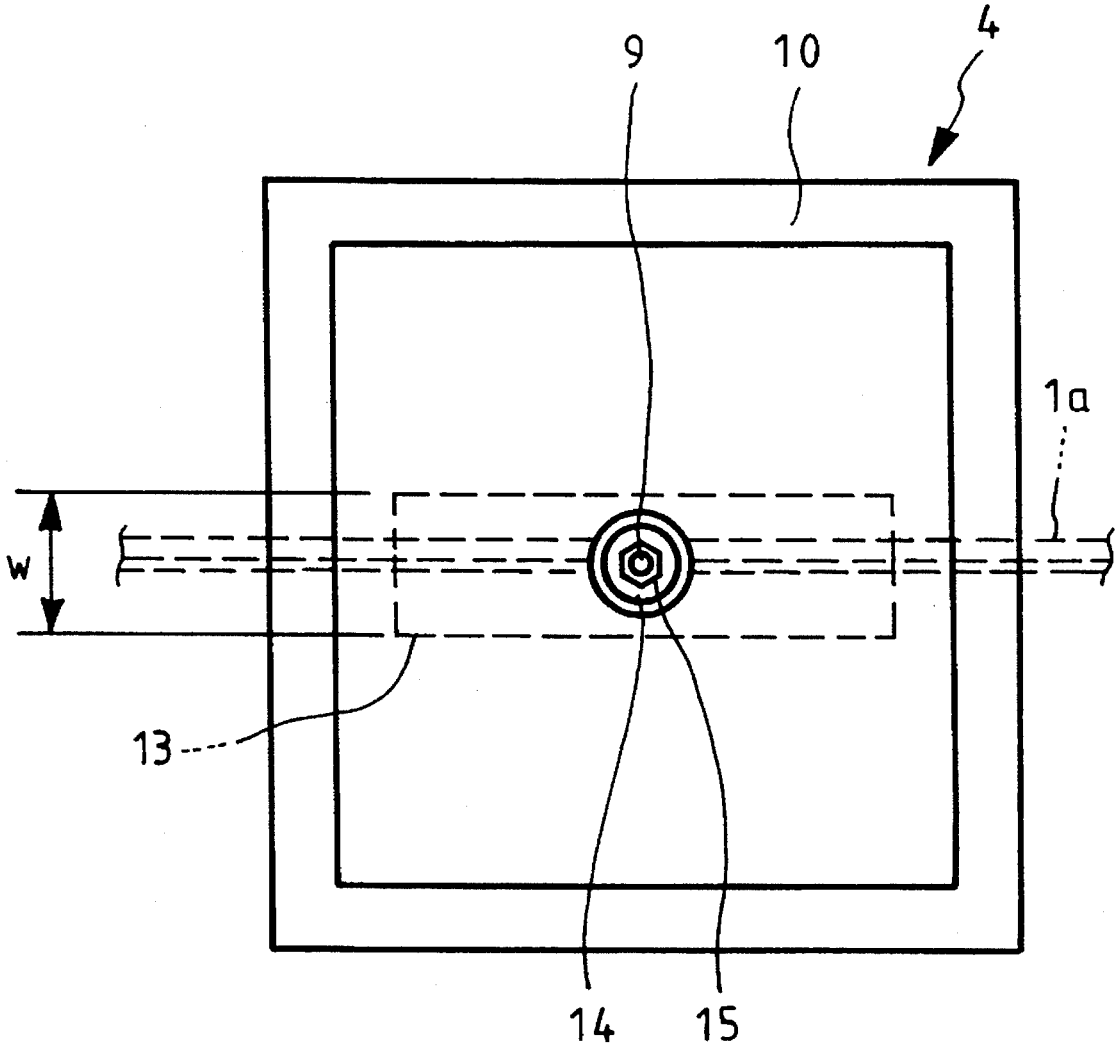
FIG. 3 is a view looking in the direction of arrows III in FIG. 2.

FIGS. 2 and 3 show an embodiment of the present invention. A tank body 1 with a stiffening member la mounted on its inner surface has a mounting member 6 fixed thereto by welding at a position on an outer surface of the tank body 1 opposite to the stiffening member 1*a*. The mounting member 6 is made of aluminum alloy and is formed with a central internal thread 5 into which an externally threaded base end 7 of a support member 9 such as rod is screwed and thus the support member 9 is protruded from the mounting member 6. The support member 9 is passed through a central bore 11 of the panel 10 larger in diameter than the support member 9. Interposed between the mounting member 6 and the panel 10 is a cylindrical member 12 for protecting the panel 10; and interposed between the outer surface of the tank body 1 and the panel 10 is a pad 13 having a width w narrower than that of the panel 10 and longitudinally extending along the stiffening member 1*a*. The support member 9 has an externally threaded tip end 8 over which a fastening member 15 such as nut is tightened through a holding member 14 such as washer, thereby mounting the panel 10 on the outer surface of the tank body 1 with a predetermined clearance c. Thus, an insulation layer 4 is provided.

With the arrangement as described above, the panel 10 is not in direct contact with the support member 9 owing to the cylindrical member 12 interposed between the mounting member 6 and the panel 10 and a given gap or space is maintained between the support member 9 and the bore 11. Therefore, the panel 10 is reliably fixed at one point at its center free from damages due to contact with the support member 9. Compared with the conventional way of fixing the panels at their four corners, the number of the support members, fastening members and holding members required is decreased, which contributes to cost reduction and to improvement of efficiency in mounting the panels. No stress occurs in the panels 10 since the panel 10 may freely contract toward a point at its center.

Wall surface portions of the tank body 1 with no stiffening member 1*a* may be deformed into corrugation due to for example the presssure of the liquefied gas inside. However, because the mounting member 6 is fixed to the outer surface of the tank body 1 opposite to the stiffening member 1*a* and the pad 13 having a width w narrower than the panel 10 and longitudinally extending along the stiffening member 1*a* is interposed between the outer surface of the tank body 1 and the panel 10 and also because the panel 10 is mounted on the outer surface of the tank body 1 with the clearance c, the panel 10 is not influenced by displacement or corrugation on the wall surface portions of the tank body 1. This contributes to the prevention of damage on the panel 10 and of excessive force applied to the mounting member 6.

Because the panel 10 is mounted on the outer surface of the tank body 1 with the clearance c, even when liquefied gas leaks from the tank body 1 by any chance, the liquefied gas moves quickly through the clearance c and is collected at a given point on the bottom of the insulation.

When each of the support member 9, the holding member 14 and the fastening member 15 is made of material having sufficient strength and high heat insulating property such as plywood, heat outside the tank body 1 is hardly transmitted into the tank body 1, which is very effective for improving insulation property of the tank body 1.

Figure 4:
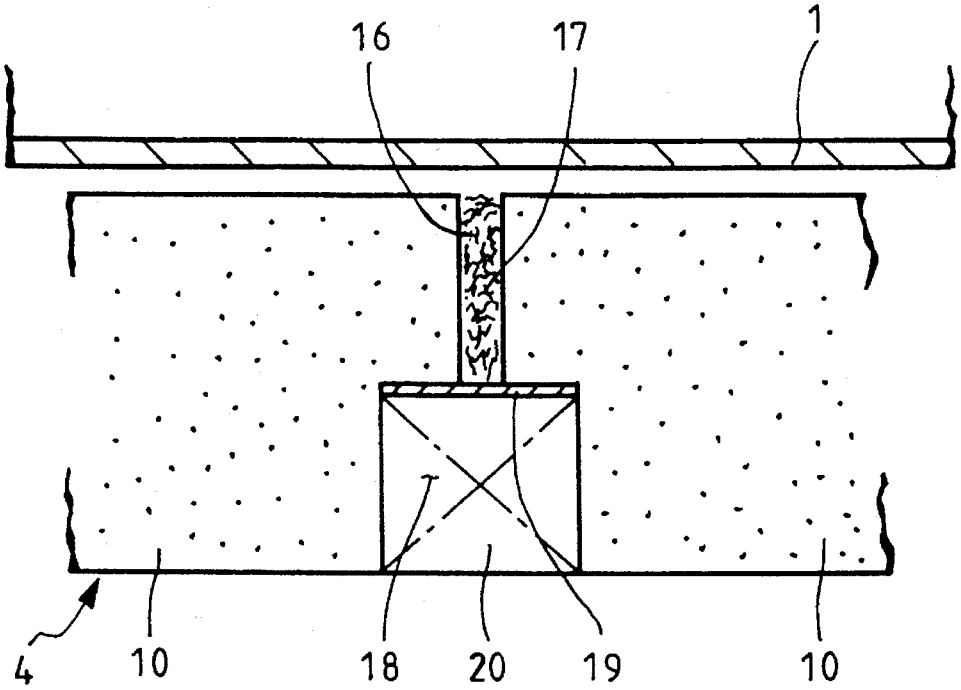
FIG. 4 is an enlarged section showing a joint between insulation panels mounted on a bottom outer surface of the tank body.

FIG. 4 shows a joint used in the present invention and between the insulation panels 10 which are as shown in FIGS. 2 and 3 and are mounted on the bottom outer surface of the tank body 1. Low- and normal-temperature-side gaps 16 and 18 are defined by opposed ends of the adjacent panels 10, the gap 18 being wider than the gap 16. An insulation material 17 such as glass wool having elasticity at low temperature is filled in the gap 16. A partition tape 19 is used to shield a boundary between the gaps 16 and 18. A heat insulator 20 made of for example polyethylene foam is airtightly fitted into the gap 18 by attaching opposite sides of the insulator 20 to the adjacent panels 10. Since the heat insulator 20, the insulation material 17 and the panel 10 are respectively made of for example polyethylene foam, glass wool and polyurethane foam, the heat insulator 20 has heat insulating property lower than that of the panel 10 but much higher than that of the insulation material 17 and has elasticity higher than that of the panel 10 at a given temperature near normal temperature.

At the bottom of the tank body 1, cold gas tends to escape to outside through the insulation material 17 filled in the gap 16 under influence of gravitational force. However, outflow of the cold gas to outside is blocked by the partition tape 19 at the boundary between the gaps 16 and 18; and heat transfer to and from outside is reliably excluded by the heat insulator 20 airtightly fitted into the gap 18. Shrinking of the panel 10 as well as influence of shrinkage of the tank body 1 cooled by low-temperature liquefied gas are absorbed by the insulation material 17 such as glass wool having elasticity at low temperature and by the heat insulator 20 made of for example polyethylene foam which has higher elasticity than polyurethane foam at a given temperature near normal temperature. Therefore, no stress occurs on the panels 10 and the joint itself between the panels 10 is not damaged since it is soft.

The joint between the panels 10 arranged as shown in FIG. 4 can attain high insulation property and can closely follow up shrinking of the tank body 1, avoiding stress in the panels 10.

Figure 5:
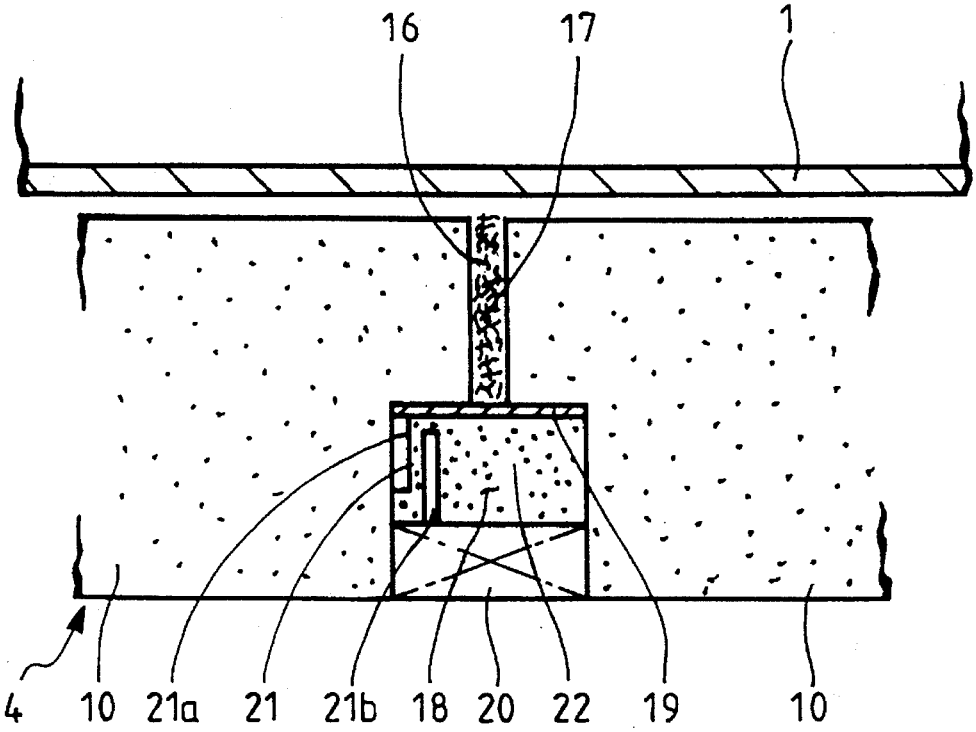
FIG. 5 is an enlarged section showing a joint between insulation panels mounted on a bottom outer surface of the tank body which is different from that shown in FIG. 4.

FIG. 5 also shows a joint between the panels 10 mounted on the bottom outer surface of the tank body 1. The structure shown in FIG. 5 is substantially similar to that shown in FIG. 4 except that an insulation joint member 22 is arranged in the normal-temperature-side gap 18 adjacent to the partition tape 19 and the heat insulator 20 is also arranged in the gap 18 away from the partition tape 19. The joint member 22 which has an elastically deformable portion 21 at its one side and is made of the same material such as polyurethane foam as the panels 10 is airtightly fitted into the gap 18 by attaching opposite sides thereof to the adjacent panels 10. The elastically deformable portion 21 is provided by forming a notch 21*a* and a slit 21*b* on said one side of the member 22.

Also in the joint shown in FIG. 5, the cold gas tends to escape to outside through the insulation material 17 filled in the gap 16 due to the influence of gravitational force. However, outflow of the cold gas to outside is blocked by the partition tape 19 at the boundary between the gaps 16 and 18: and heat transfer to and from outside is reliably excluded by the insulation joint member 22 and the heat insulator 20 both airtightly fitted in the gap 18. Shrinking of the panel 10 and influence of shrinkage of the tank body 1 cooled down by low-temperature liquefied gas are absorbed by the insulation material 17 such as glass wool having elasticity at low temperature, by the insulation joint member 22 which can be expanded or shrunk due to the elastically deformable portion 21 provided on said one side and by the heat insulator 20 such as polyethylene foam having elasticity higher than that of polyurethane foam under a given temperature near normal temperature. Therefore, no stress occurs in the panels 10. If low temperature liquefied gas leaks from the tank body 1 by any chance, the leaked liquid moves into the gap 16 through the clearance between the outer surface of the tank body 1 and the panels 10 and the joint member 22 is cooled down via the partition tape 19; however, the joint member 22 is not hardened or shrunk and is not detached from the panels 10 since the same material such as polyurethane foam as the panels 10 is used for the joint member 22. Even when the liquid flows through the partition tape 19, liquid-tightness can be satisfactorily maintained and outflow of the leaking liquid to outside is prevented.

The joint between the panels 10 as shown in FIG. 5 can also have high insulation property and closely follow up expansion or shrinking of the tank body 1, avoiding occurrence of the stress in the panels 10.

The joint structure between the panels 10 as shown in FIG. 4 or 5 may be applicable not only to the bottom of the tank body 1 but also to side or top of the tank body 1. However, at the side outer surface of the tank body 1, influence of gravitational force with respect to outflow of cold gas to outside is lower than at the bottom of the tank body 1; and at the top outer surface of the tank body 1, gravitational force works against or in a direction of preventing outflow of cold gas to outside. Therefore, it is advantageous in terms of working efficiency and cost to simplify the joint structure between the panels 10 at the side or top outer surface of the tank body 1 as compared with that at the bottom outer surface of the tank body 1.

Figure 6:
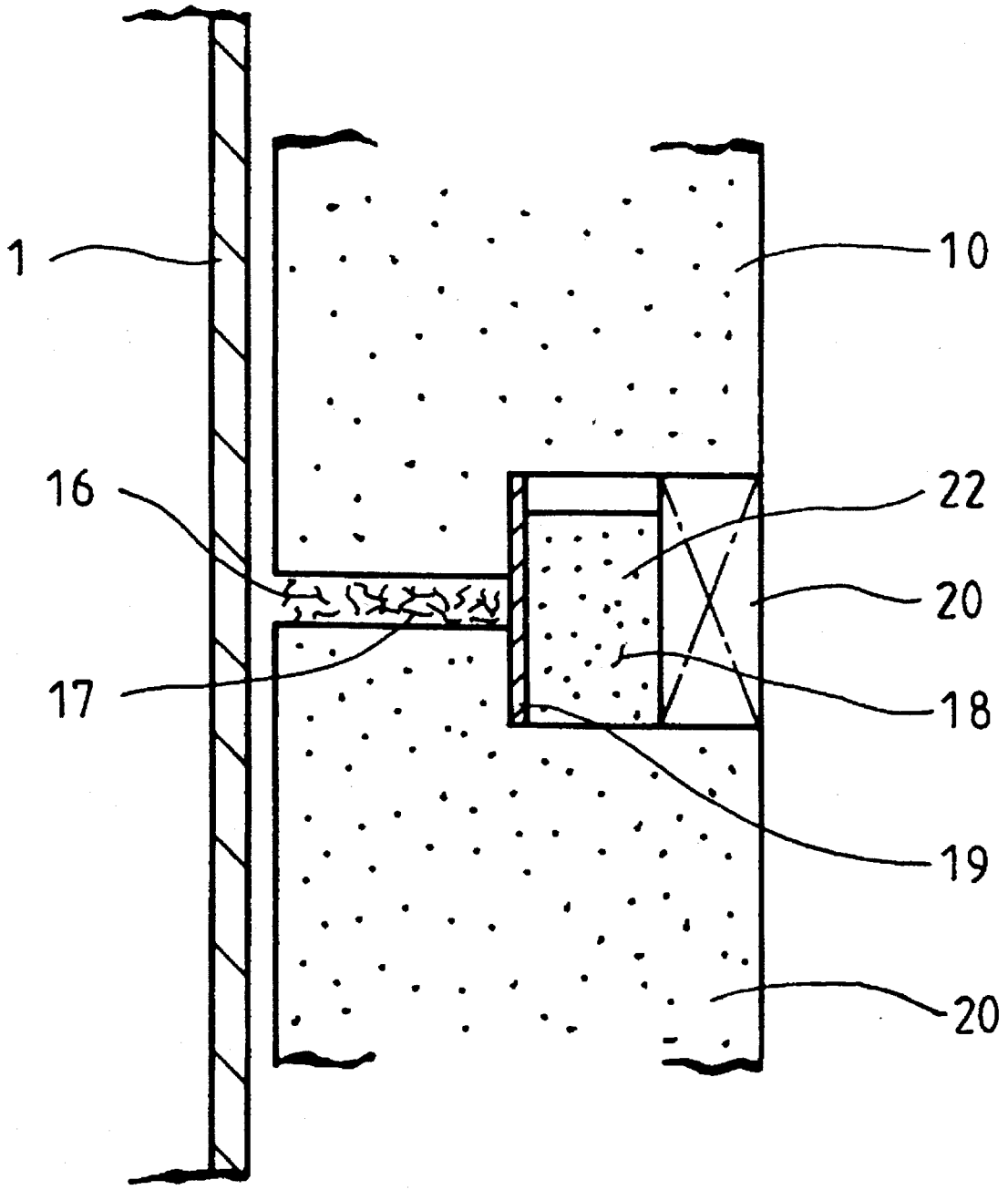
FIG. 6 is an enlarged section showing a joint between insulation panels mounted on a side outer surface of the tank body.
Figure 7:
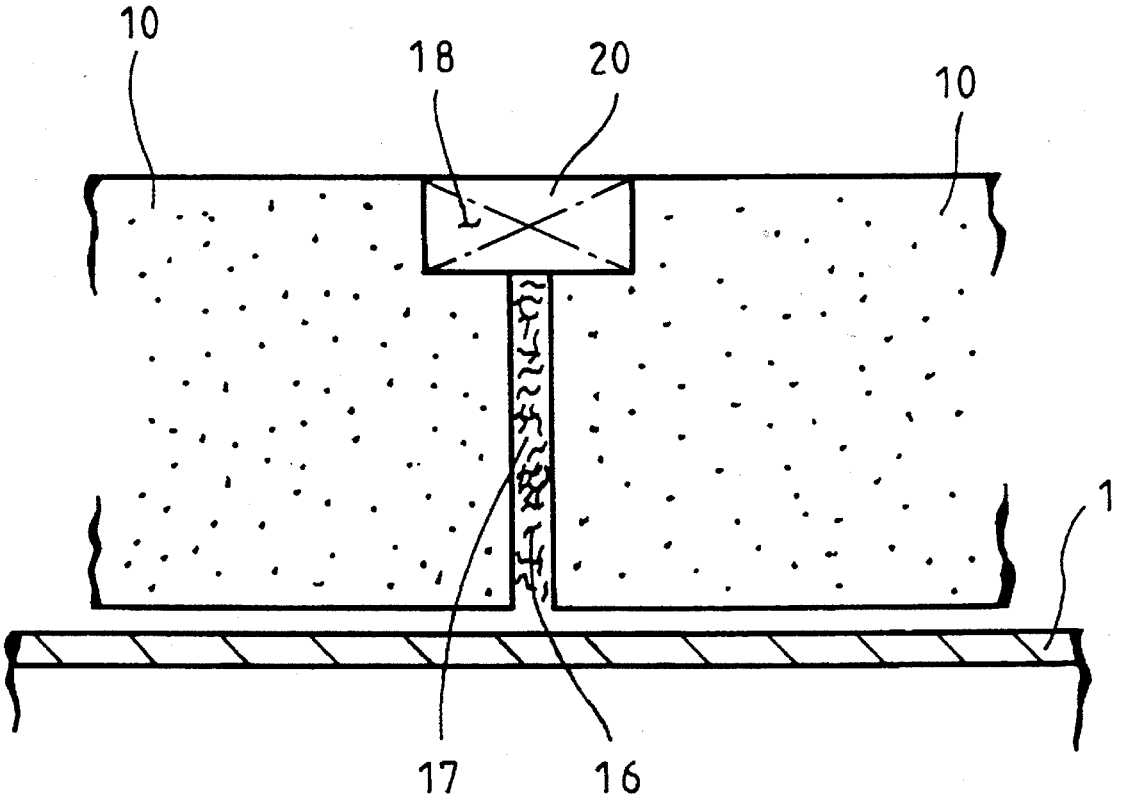
FIG. 7 is an enlarged section showing a joint between insulation panels mounted on an top outer surface of the tank body.

For this reason, a joint between the panels 10 on the side outer surface of the tank body 1 may be constructed as shown in FIG. 6. More specifically, an insulation joint member 22 made of the same material such as polyurethane foam as the panels 10 is arranged in the gap 18 adjacent to the partition tape 19 such that only one side of the joint member 22 is attached to one of the adjacent panels 10 and the opposite side of the joint member 22 is spaced apart from the other of the adjacent panels 10. The heat insulator 20 such as polyethylene foam having elasticity at a given temperature and high heat insulating property is airtightly fitted into the gap 18 by attaching both sides thereof to the adjacent panels 10. A joint between the panels 10 at the top outer surface of the tank body 1 may be constructed as shown in FIG. 7 such that low-temperature-side gap 16 has height higher than those in the joints shown in FIGS. 4 to 6. An insulation material 17 such as glass wool having elasticity at low temperature is filled into the gap 16 while a heat insulator 20 made of for example polyethylene foam having elasticity at a given temperature and high heat insulating property is airtightly fitted into the gap 18.

As shown in FIG. 6, influence of gravitational force with respect to outflow of the cold gas to outside is lower at the side outer surface of the tank body 1 than at the bottom outer surface of it. Accordingly, outflow of the cold gas to outside is reliably blocked by the partition tape 19 which shields the boundary between the gaps 16 and 18; and heat transfer to and from outside is reliably excluded by the insulation joint member 22 and the heat insulator 20 both fitted in the gap 18. Furthermore, shrinking of the panel 10 and influence of shrinkage of the tank body 1 cooled down by low-temperature liquefied gas are absorbed by the insulation material 17 having elasticity at low temperature, by the insulation joint member 22 with its one side being attached to one of the adjacent panels 10 and by the heat insulator 20 having elasticity at a given temperature and high insulating property. Thus, no stress occurs in the panels 10.

As shown in FIG. 7, at the top outer surface of the tank body 1, gravitational force works against or in a direction of preventing outflow of cold gas to outside. Therefore, outflow of the cold gas to outside is blocked with no partition tape 19 between the gaps 16 and 18 as described above. Heat transfer to and from outside is reliably excluded by the heat insulator 20 fitted into the gap 18. Influence of shrinkage of the tank body 1 cooled down by low-temperature liquefied gas is absorbed by the insulation material 17 having elasticity at low temperature and by the heat insulator 20 having elasticity at a given temperature and high insulating property. Thus, no stress occurs in the panels 10.

As is clear from FIGS. 4 to 7, a joint structure may be selected which is suitable for environmental condition of position where the panels 10 are mounted, which contributes to improvement in both working efficiency and cost.

Figure 8:
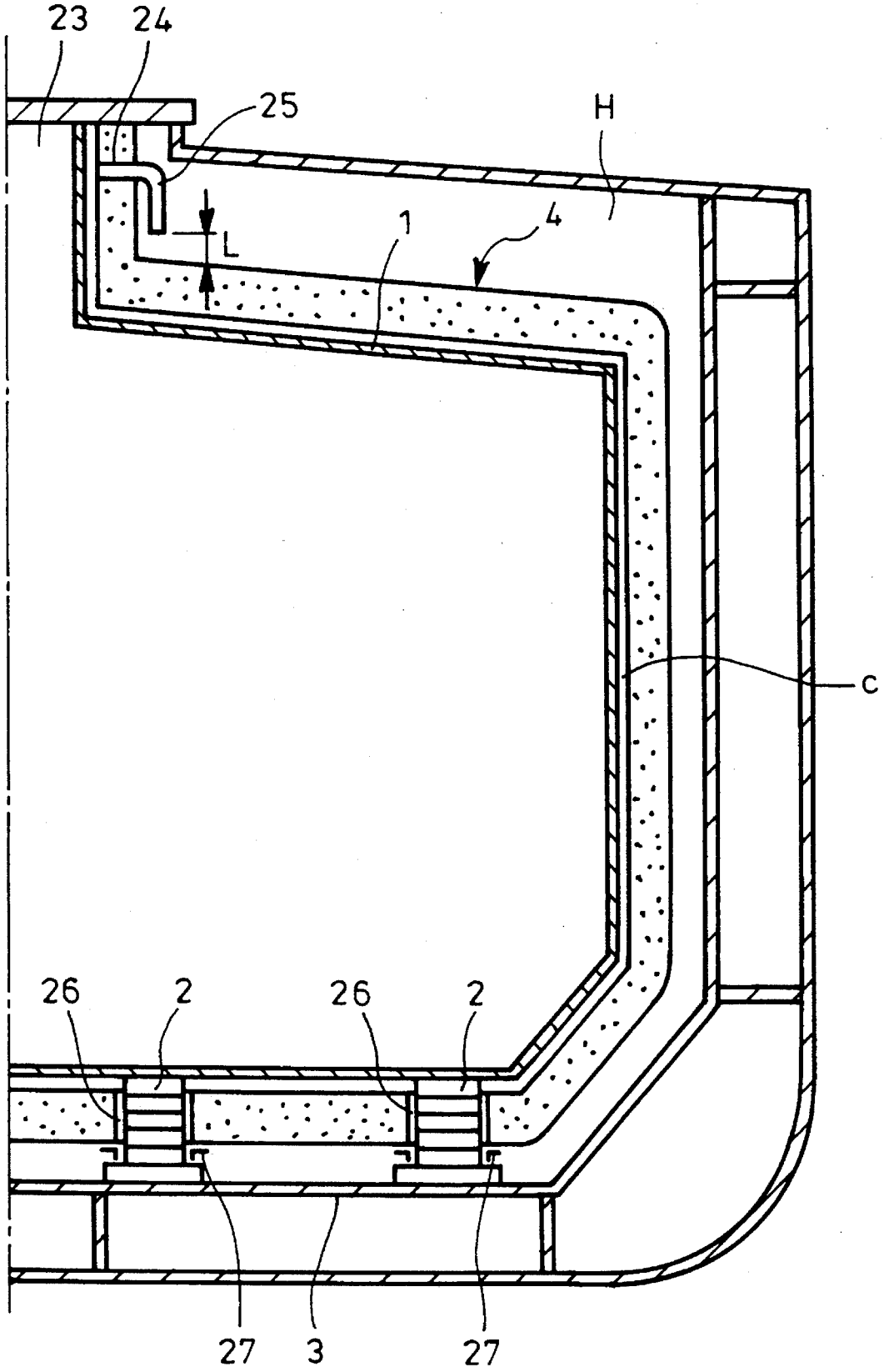
FIG. 8 is a transverse section showing an insulation layer with a balance hole according to the present invention.

However, when the panels 10 are mounted as shown in FIGS. 2 and 3 and the joints between the panels 10 as shown in FIGS. 4 to 7 are employed for formation of the insulation layer 4, airtightness becomes higher and the clearance c between the tank body 1 and the insulation layer 4 is cut off or isolated from outside of the layer 4. Therefore, any increase of the pressure in the clearance c due to for example temperature change or leakage of liquefied gas would cause the tank body 1 to be deformed or the layer 4 to be detached from the tank body 1, resulting in reduction of insulation effect. To overcome this problem, it is preferable as shown in FIG. 8 to provide a balance hole 24, passing through the layer 4 and communicating the clearance c with a hold space H outside the layer 4, at a substantially highest position on the layer 4 mounted on the outer surface of the tank body 1 (i.e. substantially at an outer periphery of a rising portion of a tank dome 23 of the tank body 1). The balance hole 24 is provided with a communicating pipe 25 an outer end of which adjacent to the hold space H is bent downward to open at height L which is about 150 cm above from the layer 4 at the top of the tank body I and which is suitable for inspection. In FIG. 8, reference numeral 26 represents a gap between the support 2 and the layer 4 to which an insulation material such as glass wool is filled: and 27, a seal such as tape for cutting off outflow of cold gas through the gap 26.

When the balance hole 24 is provided at the substantially highest position on the layer 4 as shown in FIG. 8, if the pressure of the clearance c in the layer 4 is about to vary due to for example temperature change, gas moves freely between the clearance c in the layer 4 and the hold space H outside of the layer 4 via the communicating pipe 25 in the balance hole 24. As a result, pressure in the clearance c becomes unifomized with that in the hold space H, which prevents deformation of the tank body 1 by the increase of the pressure of the clearance c in the layer 4, detaching of the layer 4 from the tank body 1 and decrease of insulation effect. Since the gas moves in and out only upon pressure changes and the balance hole 24 is at the substantially highest position on the layer 4, cold gas does not flow out of the layer 4 by gravitational force and high heat insulating property can be maintained.

It is to be understood that the insulation structure for the liquefied gas tank according to the present invention is not limited to the above embodiment and that various modifications may be made without departing from the true spirit of the present invention.

As described above, according to the insulation structure for liquefied gas tank as claimed in claim 1, it is possible to improve efficiency in mounting the insulation panels, to protect the panels and mounting members from influence of corrugation on the tank-body wall portions caused by for example the pressure of the liquefied gas inside. Even if liquefied gas leaks from the tank body by any chance, the liquefied gas quickly moves through the clearance between the tank body and the layer and is collected at a given point on the bottom of the insulation.

According to the insulation structure for liquefied gas tank as claimed in claim 2, it is possible to exclude heat transfer from outside the tank body via the support members to the tank body, which contributes to enhancing heat insulating performance of the tank body.

According to the insulation structure for liquefied gas tank according to claims 3 to 6, it is possible to attain high insulation performance, to closely follow up the shrinkage of the tank body and to prevent occurrence of stresses in the panels. According to the insulation structure for liquefied gas tank as claimed in claim 4, material having higher follow-up property and higher heat insulating property can be used for the heat insulator because temperature required for the heat insulator fitted in the outermost portion is not lowered. Also, as described in claim 5 or 6, by selecting a joint structure suitable for environmental condition of position where the insulation panel is mounted, improvement can be made in both working efficiency and cost.

According to the insulation structure for liquefied gas tank according to claims 7 to 10, it is possible to reliably prevent pressure changes inside the insulation layer, to avoid outflow of cold gas in the layer and to maintain high heat insulating performance by the layer.

What is claimed is:

1. In an insulation structure for a liquefied gas tank comprising a plurality of insulation panels to define together an insulation layer covering an outer surface of a tank body, an improvement which comprises a mounting member for each of said panels, said mounting member being fixed to the outer surface of the tank body at a position opposite to a stiffening member attached to an inner surface of the tank body, a support member protruded from said mounting member and passing through a central bore of said panel, said central bore being larger in diameter than the support member, a cylindrical member between said mounting member and the panel for protecting the panel, a pad narrower in width than the panel and longitudinally extending along said stiffening member, said pad being arranged between the outer surface of the tank body and the panel and a fastening member tightened on a tip end of said support member through a holding member, whereby each of the panels is mounted on the outer surface of said tank body with a clearance.

2. A structure according to claim 1 wherein each of said support member, holding member and fastening member is made of material having high heat insulating property.

3. A structure according to claim 1 wherein a joint between the adjacent panels has a low-temperature-side gap and a normal-temperature-side gap wider than the low-temperature-side gap both defined by the adjacent panels, an insulation material having elasticity at low temperature being filled into the low-temperature-side gap, a partition tape being applied on a boundary between said low- and normal-temperature-side gaps to shield the boundary, a heat insulator having elasticity at a given temperature being airtightly fitted into the normal-temperature-side gap.

4. A structure according to claim 1 wherein a joint between the adjacent panels has a low-temperature-side gap and a normal-temperature-side gap wider than the low-temperature-side gap both defined by the adjacent panels, an insulation material having elasticity at low temperature being filled into the low-temperature-side gap, a partition tape being applied on a boundary between said low- and normal-temperature-side gaps to shield the boundary, an insulation joint member being airtightly fitted into the normal-temperature-side gap adjacent to said partition tape, said joint member being made of the same material as the panels and having an elastically deformable portion at one side thereof, a heat insulator having elasticity at a given temperature being airtightly fitted into the normal-temperature-side gap away from said partition tape.

5. A structure according to claim 1 wherein a joint between the adjacent panels at a side outer surface of the tank body has a low-temperature-side gap and a normal-temperature-side gap wider than the low-temperature-side gap both defined by the adjacent panels, an insulation material having elasticity at low temperature being filled into the low-temperature-side gap, a partition tape being applied on a boundary between said low- and normal-temperature-side gaps to shield the boundary, an insulation joint member being fitted into the normal-temperature-side gap adjacent to said partition tape, said joint member being made of the same material as the panels and attached at one side thereof to one of said adjacent panels while the other side of the joint member is spaced apart from the other of said adjacent panels opposing thereto, a heat insulator having elasticity at a given temperature being airtightly fitted into the normal-temperature-side gap away from said partition tape.

6. A structure according to claim 1 wherein a joint between the adjacent panels at a top outer surface of the tank body has a low-temperature-side gap and a normal-temperature-side gap wider than the low-temperature-side gap both defined by the adjacent panels, an insulation material having elasticity at low temperature being filled into the low-temperature-side gap, a heat insulator having elasticity at a given temperature being airtightly fitted into the normal-temperature-side gap.

7. A structure according to claim 3 wherein the insulation layer constituted by said panels and covering the tank body with the clearance has a balance hole passing therethrough at a substantially highest position on the layer, said balance hole communicating said clearance with outside of the insulation layer.

8. A structure according to claim 4 wherein the insulation layer constituted by said panels and covering the tank body with the clearance has a balance hole passing therethrough at a substantially highest position on the layer, said balance hole communicating said clearance with outside of the insulation layer.

9. A structure according to claim 5 wherein the insulation layer constituted by said panels and covering the tank body with the clearance has a balance hole passing therethrough at a substantially highest position on the layer, said balance hole communicating said clearance with outside of the insulation layer.

10. A structure according to claim 6 wherein the insulation layer constituted by said panels and covering the tank body with the clearance has a balance hole passing therethrough at a substantially highest position on the layer, said balance hole communicating said clearance with outside of the insulation layer.

* * * * *